US011779173B2

(12) United States Patent
Nethercott

(10) Patent No.: US 11,779,173 B2
(45) Date of Patent: Oct. 10, 2023

(54) FLIPPABLE TOILET FOOTREST

(71) Applicant: SQUATTY POTTY USA, LLC, New York, NY (US)

(72) Inventor: Tony Nethercott, St. George, UT (US)

(73) Assignee: SQUATTY POTTY USA, LLC, New York, NY (US)

( * ) Notice: Subject to any disclaimer, the term of this patent is extended or adjusted under 35 U.S.C. 154(b) by 176 days.

(21) Appl. No.: 17/216,333

(22) Filed: Mar. 29, 2021

(65) Prior Publication Data

US 2021/0212528 A1 Jul. 15, 2021

Related U.S. Application Data

(62) Division of application No. 16/198,534, filed on Nov. 21, 2018, now Pat. No. 10,959,582.

(60) Provisional application No. 62/641,156, filed on Mar. 9, 2018, provisional application No. 62/590,130, filed on Nov. 22, 2017.

(51) Int. Cl.
*A47K 17/02* (2006.01)

(52) U.S. Cl.
CPC ..... *A47K 17/028* (2013.01)

(58) Field of Classification Search
CPC ..... A47C 12/00; A47C 13/00; A47C 16/02; A47C 16/025; A47C 16/04; A47C 9/002; A47K 17/02; A47K 17/028
See application file for complete search history.

(56) References Cited

U.S. PATENT DOCUMENTS

| | | | | | |
|---|---|---|---|---|---|
| 2,023,901 | A | | 12/1935 | Rhodes | |
| D139,504 | S | * | 11/1944 | Sadler | 297/183.1 |
| 4,046,417 | A | * | 9/1977 | Beckley | A47B 85/04 297/122 |
| 4,244,064 | A | * | 1/1981 | Parr | A47K 17/028 4/574.1 |
| D268,796 | S | * | 5/1983 | Kola | D6/349 |
| D274,676 | S | * | 7/1984 | Massonnet | D6/349 |
| 4,713,846 | A | * | 12/1987 | Hodroski, Jr. | A47K 17/028 4/661 |
| D297,790 | S | * | 9/1988 | Melvin | D6/350 |
| 6,966,494 | B2 | | 11/2005 | Meeker | |
| 7,097,241 | B2 | | 8/2006 | Tally et al. | |
| 7,814,581 | B1 | * | 10/2010 | Willner | A47K 17/02 D6/349 |
| D738,126 | S | | 9/2015 | Edwards | |

(Continued)

FOREIGN PATENT DOCUMENTS

FR 340599 A * 7/1904

OTHER PUBLICATIONS

Bamboo Flip Toilet Stool, https://www.squattypotty.com/shop/poop-better/bamboo-flip/, retrieved Aug. 1, 2018.

*Primary Examiner* — Erin Deery
(74) *Attorney, Agent, or Firm* — Gottlieb, Rackman & Resiman, PC

(57) ABSTRACT

A flippable toilet footrest has a first foot platform on a first side, the first foot platform having a toilet contour; a second foot platform on a second side, the second foot platform having a toilet contour; wherein in a first position, the first foot platform has a first height, and in a second position, the second foot platform has a second height. Therefore, a user may adjust the height of the footrest by flipping the footrest from one foot platform to the other.

14 Claims, 6 Drawing Sheets

(56) References Cited

U.S. PATENT DOCUMENTS

| | | | | |
|---|---|---|---|---|
| D766,604 | S | 9/2016 | Edwards | |
| D767,291 | S | 9/2016 | Edwards et al. | |
| D785,956 | S * | 5/2017 | Stricklin | D6/349 |
| D787,845 | S | 5/2017 | Edwards | |
| D797,466 | S | 9/2017 | Zioni | |
| D802,311 | S | 11/2017 | Stricklin et al. | |
| 9,895,036 | B2 * | 2/2018 | Edwards | A47K 17/028 |
| D813,560 | S | 3/2018 | Zioni | |
| 10,881,256 | B1 * | 1/2021 | Luque, Jr. | A47K 17/028 |
| 2014/0123376 | A1 | 5/2014 | Edwards et al. | |

* cited by examiner

FLIPPABLE TOILET FOOTREST

CROSS-REFERENCE TO RELATED APPLICATIONS

This application is a divisional of U.S. Non-Provisional application Ser. No. 16/198,534, filed Nov. 21, 2018, which claims the benefit of U.S. Provisional Application Ser. No. 62/590,130, filed on Nov. 22, 2017, and U.S. Provisional Application Ser. No. 62/641,156, filed on Mar. 9, 2018, all of which are incorporated herein by reference.

TECHNICAL FIELD

The present disclosure relates to toilet footrests. More particularly, the present disclosure relates to a flippable toilet footrest having a first height on a first side and second height on a second side.

BACKGROUND

Humans can perform defecation in different postures; the two most common are squatting or sitting positions. The squatting posture is usually used when using a squat toilet (mainly a feature of the developing world), or when toilets are unavailable. The sitting posture during defecation is a standard posture seen in the western world because western-style toilets usually require a sitting position with the back erect and the knees away from the chest in about a ninety-degree angle.

The anorectal angle, which is the angle formed in the colon where the puborectalis muscle wraps around the rectum, is a very important factor in maintaining continence. The sitting posture common to western-style toilets causes a narrowing of the anorectal angle and prevents the puborectalis muscle from relaxing, which may cause difficulty in emptying the bowels.

Additionally, the sitting position may cause the person to repeat the Valsalva maneuver, i.e., exhalation against a closed airway to increase internal pressure, holding his breath to increase internal pressure, which can lead to syncope. A sitting posture may increase issues related to weakness in the colon wall because of the increased straining needed to defecate.

In contrast, the squatting defecation posture involves squatting by standing with the knees and hips sharply bent and the buttocks suspended near the ground. By using the squatting defecation posture, the anorectal angle is increased, which allows the puborectalis muscle to fully relax, which aids defecation by reducing the amount of effort needed to empty the bowels.

The advantages of the squatting position may be obtained when using western-style toilets (i.e., where the bowl is raised from the ground and is intended for sitting as opposed to squatting) in conjunction with a footrest. Footrests help raise the knees toward the chest and help to lessen the normal sitting angle of about ninety-degrees to much less. As the feet are raised, the puborectalis muscle relaxes, the colon aligns allowing gravity to aid evacuation, and the required expulsive effort lessens. As such, several footrests exist in the art that are aimed at allowing a human to achieve a better anorectal angle while sitting on a toilet.

However, users come in a variety of sizes and shapes. Taller people need a different height of footrest than shorter people to achieve the desired anorectal angle. Further, many people need to adjust the height or angle of the toilet footrest due to certain medical restrictions or conditions that may inhibit their ability to fully squat. Children may also require different heights than adults. As such, there remains a need for a toilet footrest that is easily adjustable to different heights so as to accommodate users of all sizes and medical needs. The present invention seeks to solve these and other problems.

SUMMARY OF EXAMPLE EMBODIMENTS

The present disclosure is directed to an adjustable-height toilet footrest (also referred to as a "flippable" toilet footrest) while using a toilet. In one embodiment, a flippable footrest comprises a first foot platform on a first side, the first foot platform comprising a toilet contour; a second foot platform on a second side, the second foot platform comprising a toilet contour; wherein in a first position, the first foot platform has a first height, and in a second position, the second foot platform has a second height. Therefore, a user may adjust the height of the footrest by flipping/rotating the footrest from one platform to the other.

DETAILED DESCRIPTION OF EXAMPLE EMBODIMENTS

Figure 1:
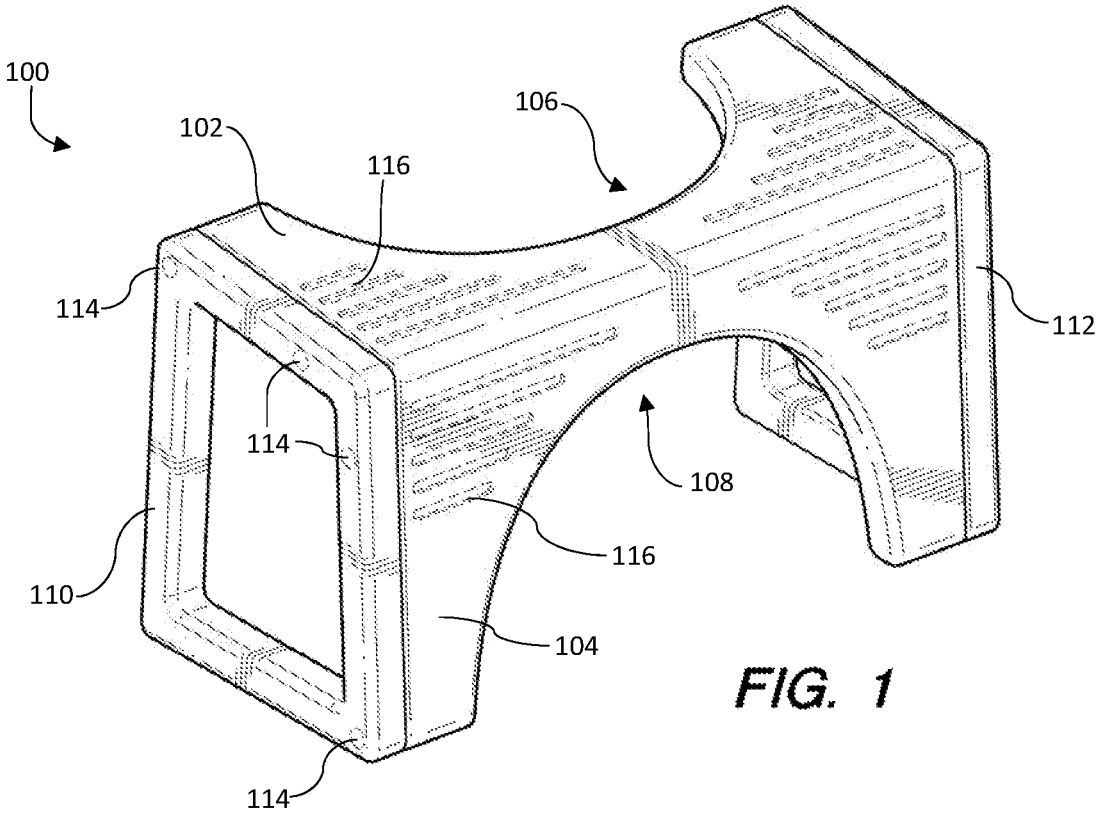
FIG. 1 is a front perspective view of the flippable toilet footrest in a first position.

The following descriptions depict only example embodiments and are not to be considered limiting of its scope. Any reference herein to "the invention" is not intended to restrict or limit the invention to exact features or steps of any one or more of the exemplary embodiments disclosed in the present specification. References to "one embodiment," "an embodiment," "various embodiments," and the like, may indicate that the embodiment(s) so described may include a particular feature, structure, or characteristic, but not every embodiment necessarily includes the particular feature, structure, or characteristic. Further, repeated use of the phrase "in one embodiment," or "in an embodiment," do not necessarily refer to the same embodiment, although they may.

Reference to the drawings is done throughout the disclosure using various numbers. The numbers used are for the convenience of the drafter only and the absence of numbers in an apparent sequence should not be considered limiting and does not imply that additional parts of that particular embodiment exist. Numbering patterns from one embodiment to the other need not imply that each embodiment has similar parts, although it may.

Accordingly, the particular arrangements disclosed are meant to be illustrative only and not limiting as to the scope of the invention, which is to be given the full breadth of the appended claims and any and all equivalents thereof. Although specific terms are employed herein, they are used in a generic and descriptive sense only and not for purposes of limitation. Unless otherwise expressly defined herein, such terms are intended to be given their broad, ordinary, and customary meaning not inconsistent with that applicable in the relevant industry and without restriction to any specific embodiment hereinafter described. As used herein, the article "a" is intended to include one or more items. When used herein to join a list of items, the term "or" denotes at least one of the items, but does not exclude a plurality of items of the list. For exemplary methods or processes, the sequence and/or arrangement of steps described herein are illustrative and not restrictive.

It should be understood that the steps of any such processes or methods are not limited to being carried out in any particular sequence, arrangement, or with any particular graphics or interface. Indeed, the steps of the disclosed processes or methods generally may be carried out in various different sequences and arrangements while still falling within the scope of the present invention.

The term "coupled" may mean that two or more elements are in direct physical or electrical contact. However, "coupled" may also mean that two or more elements are not in direct contact with each other, but yet still cooperate or interact with each other.

The terms "comprising," "including," "having," and the like, as used with respect to embodiments, are synonymous, and are generally intended as "open" terms (e.g., the term "including" should be interpreted as "including but not limited to," the term "having" should be interpreted as "having at least," the term "includes" should be interpreted as "includes but is not limited to," etc.).

As will be discussed below, the flippable footrest disclosed herein solves the need for a toilet footrest that is easily adjustable to different heights so as to accommodate users of all sizes and medical needs.

Figure 2:
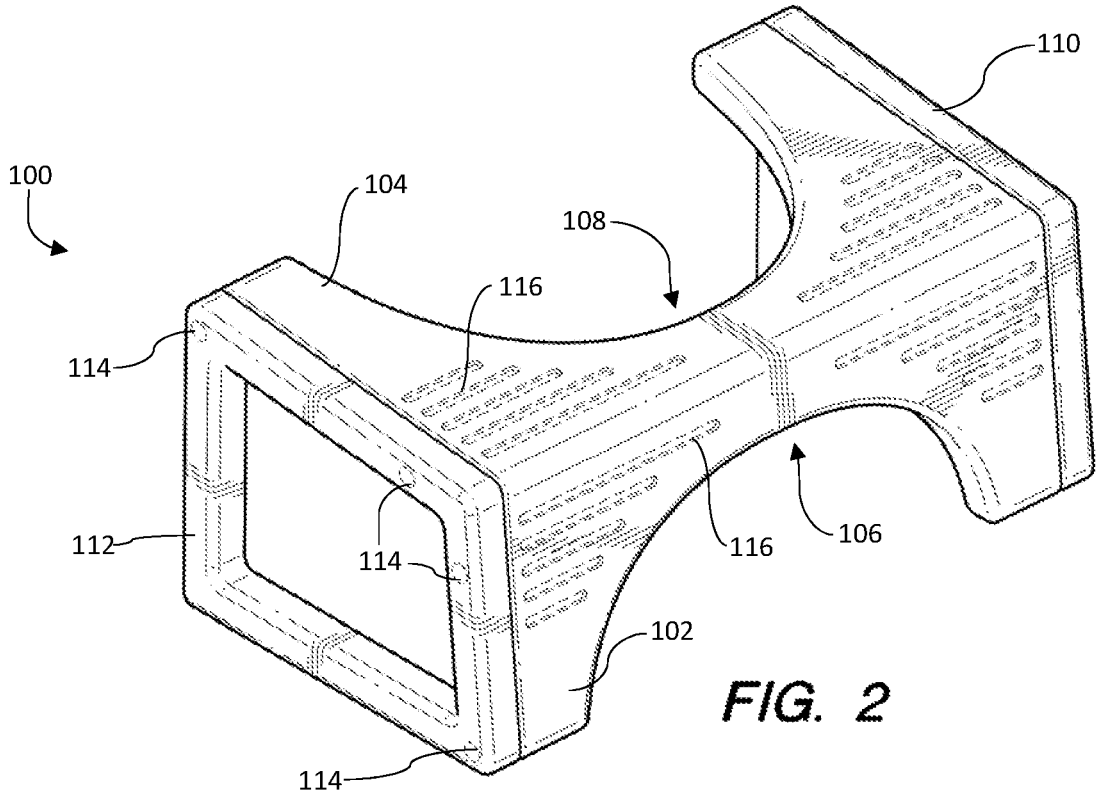
FIG. 2 is a front perspective view of the flippable toilet footrest in a second position.
Figure 3:
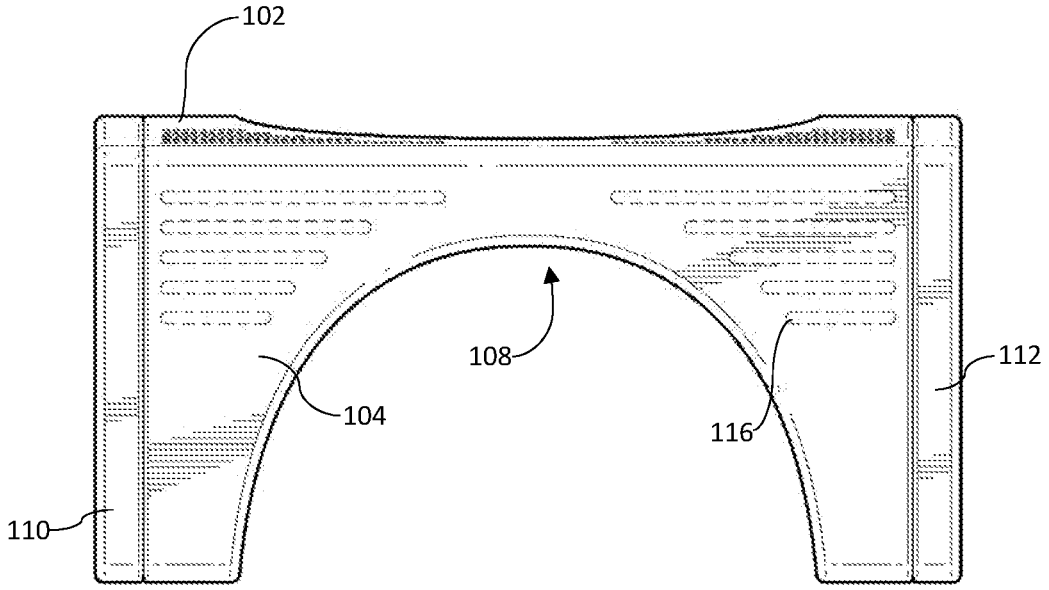
FIG. 3 is a front elevation view of the flippable toilet footrest in a first position.
Figure 4:
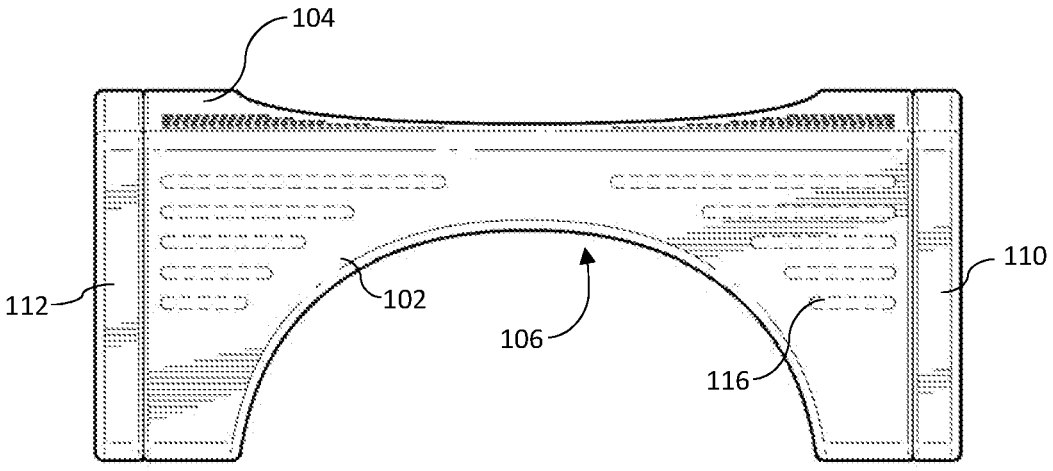
FIG. 4 is a front elevation view of the flippable toilet footrest in a second position.
Figure 5:
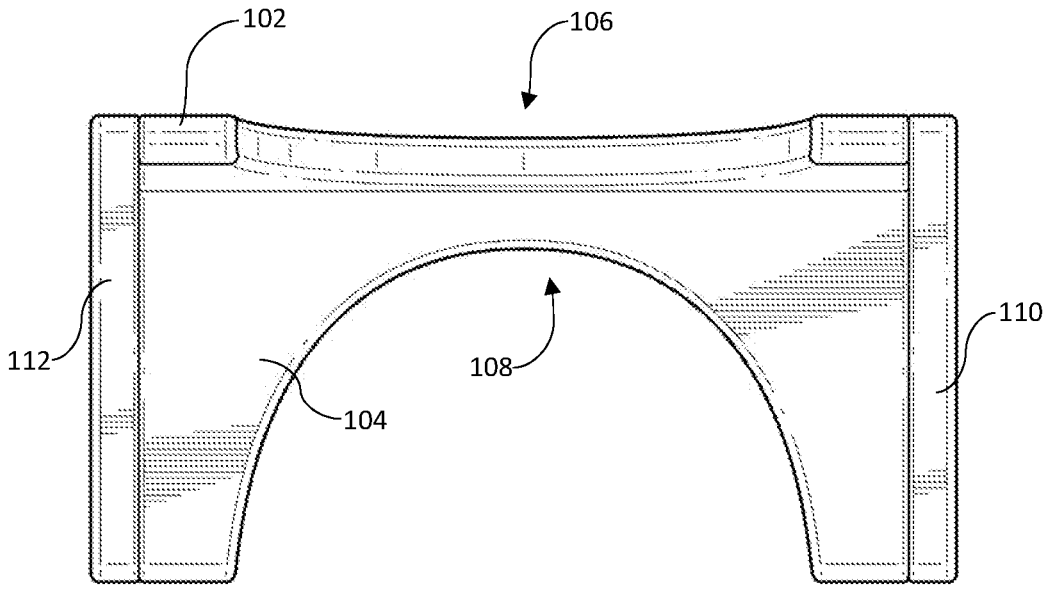
FIG. 5 is a rear elevation view of the flippable toilet footrest in a first position.
Figure 6:
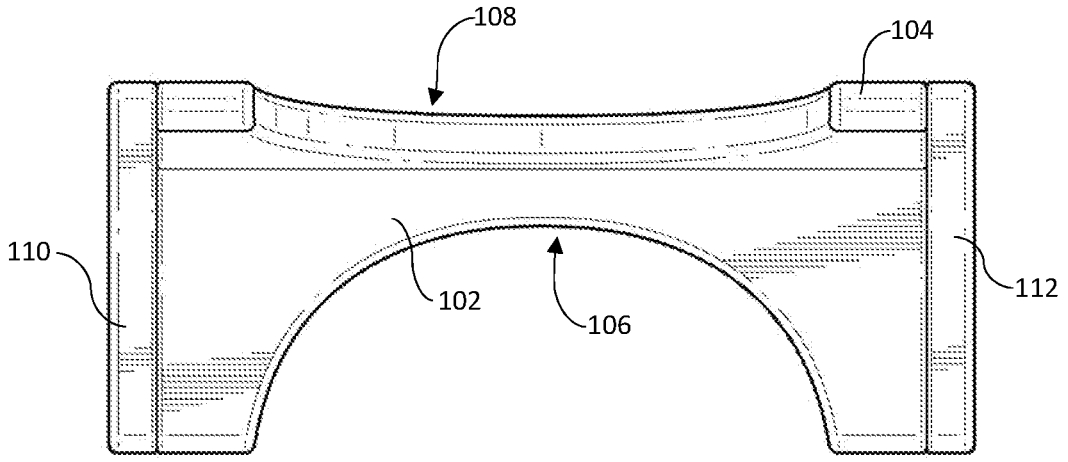
FIG. 6 is a rear elevation view of the flippable toilet footrest in a second position.

In one embodiment, as shown in FIGS. 1-7, a flippable footrest 100 comprises a first foot platform 102 for use in a first position as shown in FIG. 1, and a second foot platform 104 for use in a second position as shown in FIG. 2. In the first position shown in FIG. 1, the first foot platform 102 is positioned substantially horizontal to the ground so that a user may rest their feet thereon, the first foot platform 102 having a first height from the ground. In the first position, the second foot platform 104 is substantially vertical and functions as a sidewall of the toilet footrest 100. In a second position as shown in FIG. 2, the toilet footrest 100 has been flipped (or rotated) so that the second foot platform 104 is now substantially horizontally positioned so as to allow a user to place their feet thereon, with the first foot platform 102 functioning as a sidewall of the toilet footrest 100. In the second position, the height of the second foot platform 104 from the ground is a second height, the second height being different from the first height. In other words, in a first position, the height of the first foot platform 102 from the ground may be higher than the second foot platform 104 is from the ground when in a second position. Accordingly, a user may adjust the height of the toilet footrest 100 by flipping the toilet footrest 100 from a first position to a second position. Each foot platform 102, 104 may further comprise a contour 106, 108 for abutting a western toilet. The contour 106, 108 may be of any size and shape (curved, rectangular, square, etc.) and is intended to allow the toilet footrest 100 to abut the base of a western toilet when not in use, allowing it to be stored out of the way.

Figure 7:
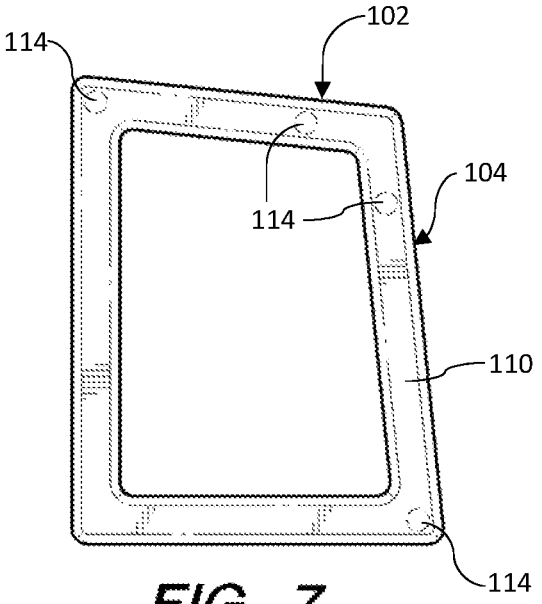
FIG. 7 is a side view of the flippable toilet footrest in a first position.

The first foot platform 102 and the second foot platform 104 may be manufactured from a variety of materials, including plastics, woods, fiberglass, metals, and any other material suitable for supporting the legs of a user while using the toilet. The first foot platform 102 and second foot platform 104 may be of a single manufacture or may be two separate components joined together. The foot platforms 102, 104 may be at a 90-degree angle to one-another, but may also be at an obtuse (as shown in FIG. 7) or acute angle. Further, in a first position, the first foot platform 102 may be parallel to the ground or it may be angled (as best shown in FIG. 7), and in a second position, the second foot platform 104 may be parallel to the ground or it may also be angled. Foot platform 100 further comprises a first leg 110 and a second leg 112. Each leg 110, 112 is cuboidal and supports the first foot platform 102 in the first position and the second foot platform 104 in the second position. The legs 110, 112 may be coupled to the first and second foot platforms 102, 104 using a plurality of screws 114 or similar fasteners. Each foot platform 102, 104 may further comprise a non-slip surface, such as grooves 116. However, the non-slip surface may also be surface materials or texturing as well, and need not be grooves 116.

Figure 8:
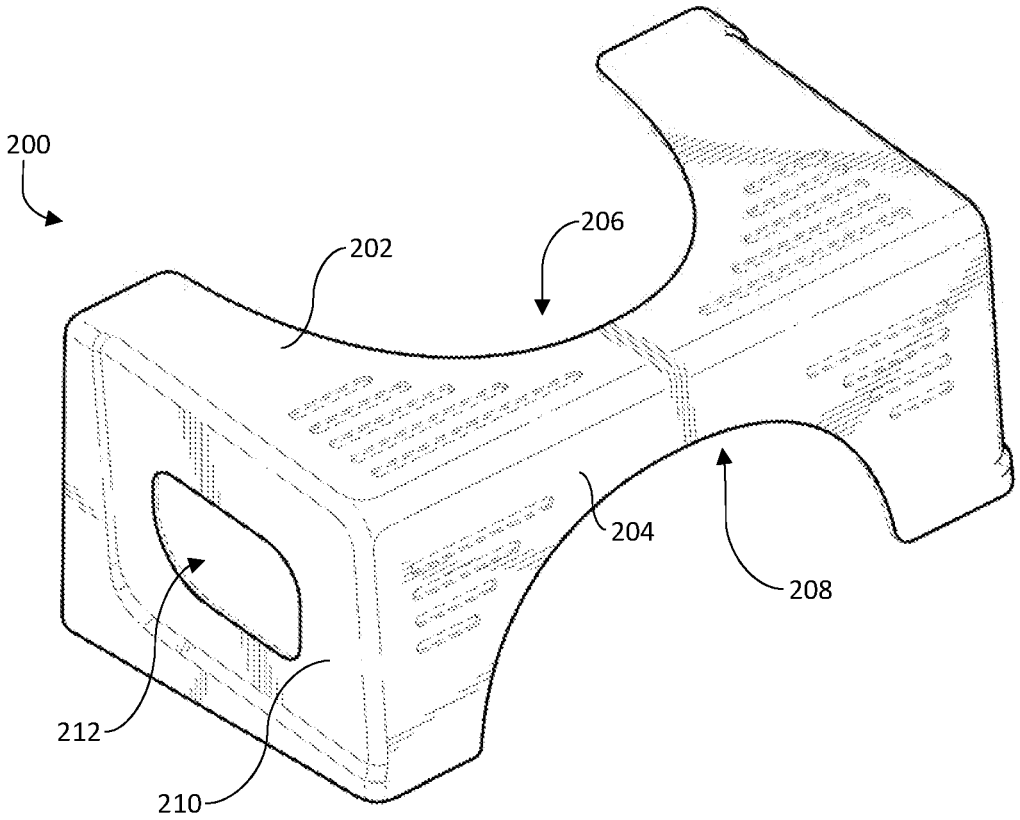
FIG. 8 is a front perspective view of the flippable toilet footrest in a first position.
Figure 9:
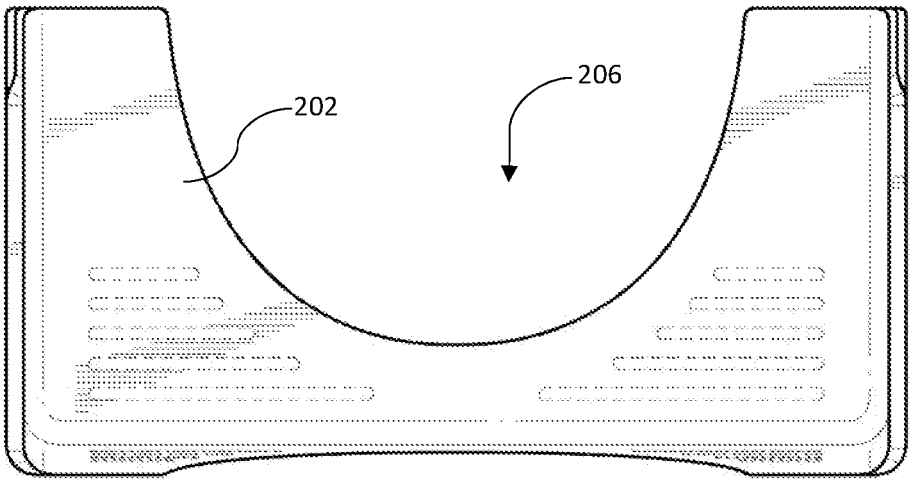
FIG. 9 is a top plan view of the flippable toilet footrest in a first position.
Figure 10:
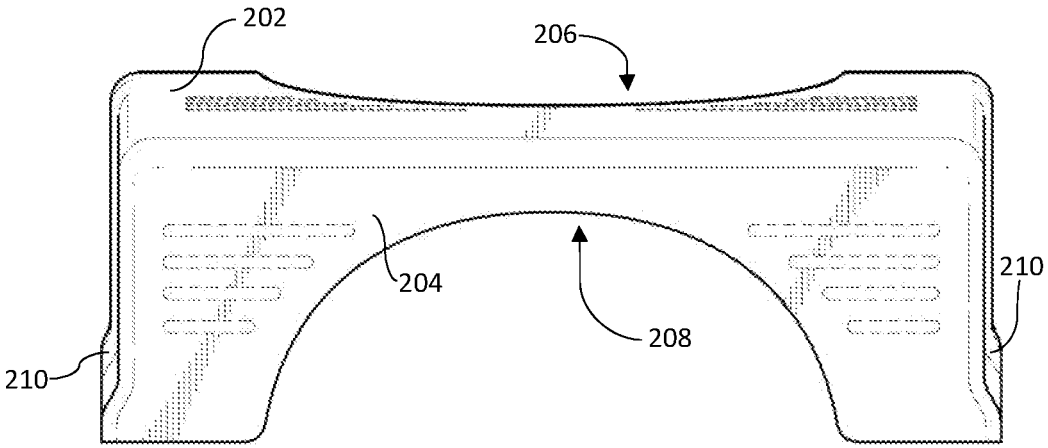
FIG. 10 is a front elevation view of the flippable toilet footrest in a first position.
Figure 11:
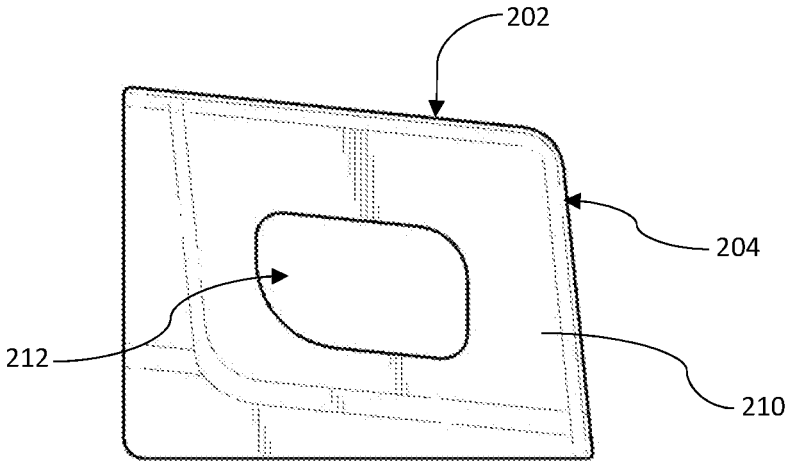
FIG. 11 is a side view of the flippable toilet footrest in a first position.

Referring now to FIGS. 8-11, a toilet footrest 200 comprises a first foot platform 202 for use in a first position as shown in FIG. 8, and a second foot platform 204 for use in a second position. In the first position shown in FIG. 8, the first foot platform 202 is positioned substantially horizontal to the ground so that a user may rest their feet thereon, the first foot platform 202 having a first height from the ground. In the first position, the second foot platform 204 is substantially vertical and functions as a front sidewall of the toilet footrest 200. In a second position, the toilet footrest 200 is flipped and rotated so that the second foot platform 204 is substantially horizontally positioned so as to allow a user to place their feet thereon, with the first foot platform 202 functioning as the front sidewall of the toilet footrest 200. In the second position, the height of the second foot platform 204 from the ground is a second height, the second height being different from the first height. Accordingly, a user may adjust the height of the toilet footrest 200 by flipping the toilet footrest 200 from a first position to a second position. Each foot platform 202, 204 may further comprise a contour 206, 208 for abutting a western toilet. The contour 206, 208 may be of any size and shape (curved, rectangular, square, etc.) and is intended to allow the toilet footrest 200 to abut the base of a western toilet when not in use, allowing it to be stored out of the way. By each foot platform 202, 204 comprising a contour 206, 208, the toilet footrest 200 may abut the toilet regardless of whether it is in the first position or second position. The toilet footrest 200 may have sidewalls 210 that support the first and second foot platforms 202, 204 in the first and second position, respectively. The sidewalls 210 may be solid or, as shown, may comprise a cutout 212. Cutout 212 reduces material, which reduces weight and cost. The toilet footrest 200 may be manufactured as a single unit (e.g., injection molding) or may be formed from various components coupled together using screws, bolts, glues, or other fasteners. For example, each platform 202, 204 may be a separate component (e.g., wood), with each component being secured to the other (e.g., adhesive, bolts, screws, nails, etc.).

In one method of use, a user would place the toilet footrest 100, 200 near the base of a toilet. In a first position, a user would sit on the toilet and rest their feet on the first foot platform 102, 202. If the user desires a different height, the user may simply flip the toilet stool 100, 200 to the second position (i.e., rotate and spin) and place their feet on the second foot platform 104, 204. As appreciated, the user is able to quickly and easily change the height of the toilet footrest 100, 200 for their use while on a toilet without needing tools and without requiring disassembly or reassembly of components. Therefore, the toilet footrest 100, 200 described herein solves the need for a toilet footrest that is easily adjustable to different heights so as to accommodate users of all sizes and medical needs.

While the forgoing examples are illustrative of the principles of the present invention in one or more particular applications, it will be apparent to those of ordinary skill in the art that numerous modifications in form, usage and details of implementation can be made without the exercise of inventive faculty, and without departing from the principles and concepts of the invention. Accordingly, it is not intended that the invention be limited, except as by the claims set forth below.

What is claimed is:

1. A flippable footrest, comprising:

a first foot platform extending along a first plane and including a first curved contour extending inwardly from a first side of the first foot platform toward a second side of the first foot platform;

a second foot platform extending along a second plane that intersects with the first plane and including a second curved contour extending inwardly from a first side of the second foot platform toward a second side of the second foot platform;

a first leg supporting a first side of the first platform and a first side of the second foot platform and including a first side, a second side contiguous to and extending from the first side, a third side spaced from the first side and contiguous to and extending from the second side and a fourth side spaced from the second side and contiguous to and extending from the third side with the first side, the second side, the third side and the fourth side together defining an opening therebetween; and a second leg supporting a second side of the first platform and a second side of the second foot platform and including a first side, a second side contiguous to and extending from the first side, a third side spaced from the first side and contiguous to and extending from the second side and a fourth side spaced from the second side and contiguous to and extending from the third side with the first side, the second side, the third side and the fourth side together defining an opening therebetween;

wherein, in a first position, the first foot platform has a first height, with the third side of the first leg and the third side of the second leg being adjacent to a floor; and wherein, in a second position, the second foot platform has a second height, with the fourth side of the first leg and the fourth side of the second leg adjacent to the floor, and the first foot platform and the third side of each of the first leg and the second being leg in a substantially vertical position, and wherein the first side, the second side, the third side and the fourth side of each of the first leg and the second leg together define a quadrilateral with the first side of each of the first leg and the second leg extending between the fourth side and the second side at a first angle and the second side of each of the first leg and the second leg extending between the first side and the third side at a second angle, such that in the first position, the first foot platform extends along the first plane, Which extends in a downward direction at the first angle from a first end of the first side toward the second foot platform and in the second position, the second foot platform extends along the second plane, which extends in a downward direction at the second angle from the second end of the second side toward the first foot platform.

2. The flippable footrest of claim 1, wherein the second height is less than the first height.

3. The flippable footrest of claim 1, wherein each of the first leg and the second leg is fastened to the first foot platform and the second foot platform by fasteners.

4. The flippable footrest of claim 3, wherein the fasteners are threaded fasteners.

5. The flippable footrest of claim 1, wherein the first foot platform and the second foot platform are coupled together at an obtuse angle.

6. A flippable footrest, comprising:

a first foot platform;

a second foot platform coupled directly to the first foot platform at an angle that is greater than ninety degrees;

a first leg having four sides, including a first leg side, a second leg side, a third leg side and a fourth leg side located adjacent to and in direct contact with a first side of both the first foot platform and the second foot platform;

a second leg having four sides, including a first leg side, a second leg side, a third leg side and a fourth leg side located adjacent to and in direct contact with an opposite; second side of both the first foot platform and the second foot platform;

wherein, in a first position, the first foot platform has a first height, wherein, in a second position, the second foot platform has a second height that is less than the first height, the first foot platform being substantially vertical, and wherein the first leg side, the second leg side, the third leg side and the fourth leg side of each of the first leg and the second leg together define a quadrilateral with the first leg side of each of the first leg and the second leg extending at a first angle which extends downwardly from a first end toward the second leg side of each of the first leg and the second leg and the second leg side extending between a second end of the first leg side and a second end of the third leg side at a second angle which extends downwardly, such that in the first position, the first foot platform extends from the first end of the first leg side toward the second foot platform at the first angle and in the second position, the second foot platform extends at the second angle from a second end of the second leg side toward the first foot platform.

7. The flippable footrest of claim 6, wherein the first leg side, the second leg side, the third leg side and the fourth leg side of the first leg define a void and the first leg side, the second leg side, the third leg side and the fourth leg side of the second leg define a void.

8. The flippable footrest of claim 6, wherein the first platform comprises a contour.

9. The flippable footrest of claim 8, wherein the contour is curved.

10. The flippable footrest of claim 6, wherein the second platform comprises a contour.

11. The flippable footrest of claim 6, wherein, in the first position, the second leg side and the fourth leg side extend downwardly from the first leg side to the third leg side that is contactable with a surface.

12. The flippable footrest of claim 11, wherein, in the second position the first leg side and the third leg side extend downwardly from the second leg side to the fourth leg side that is contactable with the surface.

13. The flippable footrest of claim 12, wherein the second leg side of each of the first leg and the second leg is secured to the second foot platform by fasteners, and the first leg side of each of the first leg and the second leg is secured to the first foot platform by fasteners.

14. The flippable footrest of claim 13, wherein the fasteners are threaded fasteners.

* * * * *